US005435800A

United States Patent [19]

Nelson

[11] Patent Number: 5,435,800

[45] Date of Patent: Jul. 25, 1995

[54] WEIGHT CARRYING MEMBER WITH FRICTIONALLY ENGAGABLE WEIGHTS

[76] Inventor: Thomas F. Nelson, 3000 W. Clarke St., Milwaukee, Wis. 53210

[21] Appl. No.: 104,793

[22] Filed: Aug. 11, 1993

[51] Int. Cl.[6] ..... A63B 21/06

[52] U.S. Cl. ..... 482/108; 482/908

[58] Field of Search ..... 482/44, 45, 46, 47, 482/48, 49, 50, 93, 105, 106, 107, 108, 109, 110, 139, 908

[56] References Cited

U.S. PATENT DOCUMENTS

| | | | |
|---|---|---|---|
| 3,690,655 | 9/1972 | Chapman | 482/93 X |
| 4,109,908 | 8/1978 | Pugh et al. . | |
| 4,231,569 | 11/1980 | Rae | 482/93 X |
| 4,345,756 | 8/1982 | Hoagland . | |
| 4,377,282 | 3/1983 | Hayes . | |
| 4,589,655 | 5/1986 | Ammon . | |
| 4,607,840 | 8/1986 | Harper . | |
| 4,817,944 | 4/1989 | Anderson et al. | 482/107 |
| 4,943,052 | 7/1990 | Powers . | |
| 5,100,126 | 3/1992 | Liou | 482/46 |
| 5,102,124 | 4/1992 | Diodati | 482/107 |

FOREIGN PATENT DOCUMENTS

| | | | |
|---|---|---|---|
| 70350 | 7/1912 | Austria | 482/109 |

*Primary Examiner*—Richard J. Apley
*Assistant Examiner*—John Mulcahy
*Attorney, Agent, or Firm*—Michael, Best & Friedrich

[57] ABSTRACT

An exercise device including an elongated weight carrying member having a longitudinal axis and an outer surface including a plurality of edge portions, at least one weight slidably mounted on the weight carrying member, and a weight securing arrangement for releasably securing the weight on the weight carrying member. The weight securing arrangement includes an aperture in the weight dimensioned and shaped so that, when the weight is rotated relative to the longitudinal axis from a first angular position to a second angular position, the inner wall of the aperture frictionally engages the weight carrying member and prevents movement of the weight. The device also includes a body having a pair of parallel spaced legs and a grip portion which is gripped by a user to perform an exercise movement. The grip portion includes a movable handle extending transversely between the legs and having opposed end portions. A retainer member is mounted on each leg and includes a deflectable portion which is deflectable between undeflected and deflected positions and has spaced detent notches. Each handle end portion includes a slot for receiving a respective leg, an opening offset axially outwardly from the slot to permit the handle end portion to pass over the retainer member when the deflectable portion is in the deflected position, and a protrusion on one side of the opening for registering with a detent notch and preventing movement of the handle when the deflectable portion is in the undeflected position.

12 Claims, 1 Drawing Sheet

WEIGHT CARRYING MEMBER WITH FRICTIONALLY ENGAGABLE WEIGHTS

BACKGROUND OF THE INVENTION

1. Field of the Invention

The invention relates to exercise devices. More particularly, the invention relates to exercise devices employing one or more weights removably mounted on a support to vary the exercise load. The invention also relates to exercise devices including a handle which can be adjusted to accommodate different hand sizes or exercises.

2. Reference to Prior Art

Prior art exercise devices utilize a variety of methods for securing a weight on a weight carrying member. Typically, a retaining collar secures the weight against a stop or another collar. The collars are typically fastened to the weight carrying member with set screws. Such collars are illustrated in Pugh U.S. Pat. No. 4,109,938, issued Aug. 29, 1978. Hoagland U.S. Pat. No. 4,345,755, issued Aug. 24, 1982, illustrates a retaining collar including an internally threaded aperture, so that the collar can be threaded onto external threads on a weight carrying member. Powers U.S. Pat. No. 4,943,052, issued Jul. 24, 1990, discloses securing a weight on a barbell with a clamp which holds the weight against a stop on the bar.

Each of the above described devices requires an additional collar or clamp to secure the weight on the weight carrying member. If a collar is used, it must be secured on the weight carrying member by tightening a set screw or screwing the collar onto threads on the weight carrying member.

Prior art devices employ a variety of means for adjustably positioning a handle on an exercise device. For example, Harper U.S. Pat. No. 4,607,840 discloses the use of set screws to adjust and secure a handgrip. Ammon U.S. Pat. No. 4,589,655 discloses the use of a pair of set screws and a number of apertures to vary the distance between arcuate members of a frame. It also discloses the use of a plurality of holes for receiving removable bolts to vary the position of a grip unit. Hayes U.S. Pat. No. 4,377,282 discloses the use of pins which pass through holes in a sleeve to adjust the position of a grip.

The Harper and Ammon devices both require unfastening and fastening a screw or bolt in order to adjust the position of the handle on an exercise device. The Hayes device requires removing a pin from a hole and then moving and installing it in another hole to adjust the position of the grip.

SUMMARY OF THE INVENTION

An object of the invention is to provide an exercise device having at least one weight slidably mounted on a weight carrying member and means for conveniently and releasably securing the weight at various positions on the weight carrying member to vary the exercise load.

Another object of the invention is to provide an exercise device having a handle which can be conveniently and adjustably positioned to permit different exercises and accommodate different sized hands.

A further object of the invention is to provide an exercise device supplying a wide range of exercise loads to the user.

Other objects, aspects and advantages of the invention will become apparent to those skilled in the art upon reviewing the following detailed description, drawings and appended claims.

The invention provides an exercise device including a body, an elongated weight carrying member, at least one weight slidably mounted on the weight carrying member and weight securing means for releasably securing the weight at selected positions on the weight carrying member. The weight carrying member extends forwardly from the body and has a longitudinal axis and an outer surface including a plurality of edge portions extending parallel to the longitudinal axis. The weight securing means includes an aperture in the weight through which the weight carrying member extends. The aperture is dimensioned and shaped so that when the weight is rotated relative to the longitudinal axis to a first angular position, the weight is free to slide along the weight carrying member and, when the weight is rotated relative to the longitudinal axis to a second angular position, the inner wall of the aperture frictionally engages at least two edge portions of the weight carrying member, thereby preventing longitudinal movement of the weight relative to the weight carrying member. Preferably, the inner wall of the aperture or the edge portions of the weight carrying member are covered with a deformable, resilient material.

In one embodiment, the device includes a U-shaped body and a grip portion. The body includes a pair of parallel spaced legs connected by a cross member. The grip portion includes a movable handle having opposed end portions and extending transversely between the legs. A retainer member is mounted on each leg and includes a deflectable portion having a plurality of detent notches for releasably holding the handle in selected positions on the legs. Each handle end portion includes a slot for receiving a respective leg and an opening offset axially outwardly from the leg receiving slot and dimensioned to permit the handle end portion to pass over the deflectable of the retainer member when it is in the deflected position. One side of the opening includes a protrusion for registering with a detent notch and preventing subsequent movement of the handle when the deflectable portion is in the undeflected position. When the deflectable portion of the retainer member is deflected to the deflected position, a detent notch is moved out of registration with the protrusion and the handle is free to be moved relative to the leg.

DETAILED DESCRIPTION OF A PREFERRED EMBODIMENT

Figures 1, 2, 3, 4, 5, 6:
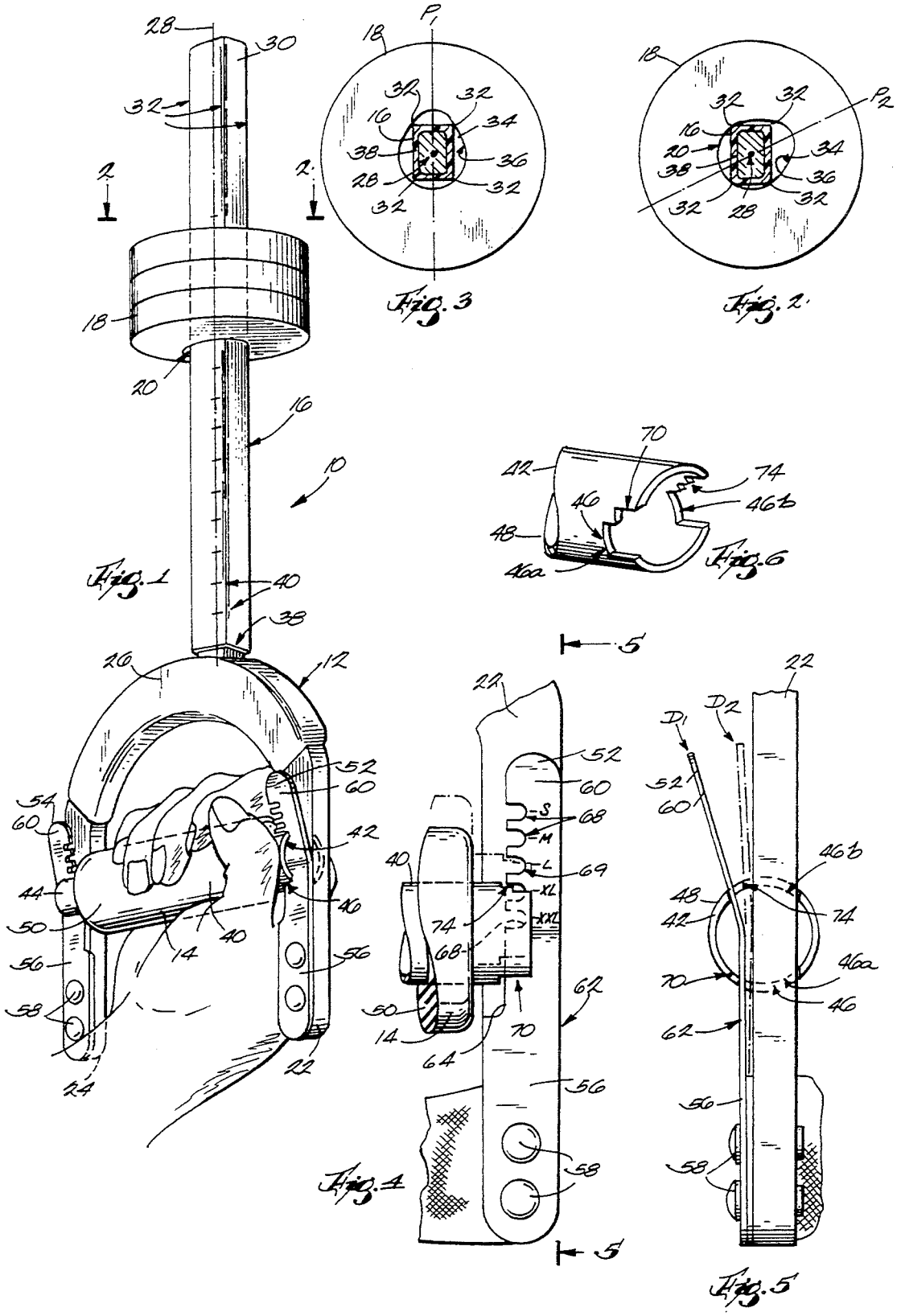
FIG. 1 is a perspective view of an adjustable exercise device embodying the invention.
FIG. 2 is a sectional view taken generally along line 2—2 in FIG. 1, showing the weight rotated to an angular position in which it is releasably secured to the weight carrying member.
FIG. 3 is a sectional view similar to FIG. 2 showing the weight rotated to an angular position in which it is free to slide on the weight carrying member.
FIG. 4 is an enlarged fragmentary top plan view of one end portion of the handle and the detent mechanism therefor.
FIG. 5 is a side elevational view taken generally along line 5—5 in FIG. 4.
FIG. 6 is a perspective view of the end portion of the handle shown generally in FIG. 4.

While the invention can be used in connection with a wide variety of exercise devices employing one or more weights removably and/or slidably mounted on a weight carrying member to vary the exercise load, or in connection with exercise devices including a position adjustable handle, it is particularly adapted for a hand and forearm exercise device and will be described in connection with that application.

Illustrated in FIG. 1 is a hand and forearm exercise device 10 incorporating the invention. The exercise device 10 includes a body 12, a grip portion 14 which is gripped by a user for performing an exercise movement, an elongated weight carrying member 16 connected to the body 12, at least one and preferably a plurality of weights 18 slidably mounted on the weight carrying member 16, and weight securing means 20 for releasably securing the weights 18 at selected positions on the weight carrying member 16 to vary the exercise load.

The body 12 includes a generally U-shaped member having a pair of parallel spaced legs 22,24 connected by an arcuate cross member 26. The legs 22,24 extend rearwardly from the cross member 26 and are spaced far enough apart to accommodate therebetween the largest anticipated width of an exerciser's hand. The elongated weight carrying member 16 is connected to cross member 26 and extends forwardly therefrom in a direction opposite from the legs 22,24. The weight carrying member 16 has a longitudinal axis 28 and an outer surface 30 including a plurality of opposed edge portions 32 extending parallel to the longitudinal axis 28. In the illustrated embodiment, the weight carrying member 16 has a rectangular cross-sectional shape and includes four edge portions 32.

Referring to FIGS. 1, 2 and 3, the weight securing means 20 includes a generally egg-shaped aperture 34 in each weight 18 having an inner wall 36. The aperture 34 is dimensioned and shaped so that, when a weight 18 is rotated relative to the longitudinal axis 28 to a first angular position $P_1$ (FIG. 3) the weight 18 is free to slide along the weight carrying member 16, and, when the weight 18 is rotated relative to the longitudinal axis to a second angular position $P_2$ (FIG. 2), the inner wall 36 of the aperture 34 frictionally engages at least two opposite edge portions 32 of the weight carrying member 16, thereby preventing subsequent longitudinal movement of the weight 18 relative to the weight carrying member 16. The described arrangement for securing the weights 18 is advantageous over prior art devices because moving and mounting the weights 18 is relatively simple and does not require extra collars or clamps and tightening set screws or the like.

While in the preferred embodiment illustrated the aperture 34 is generally egg-shaped and the weight carrying member 16 is rectangular, it should be understood that the aperture 34 and the weight carrying member 16 can have other dimensions and/or shapes so long as there is frictional engagement between at least two generally opposed edge portions 32 of the weight carrying member and the inner wall 36 of the aperture 34 in a first angular position and clearance for movement of the weight 18 along the weight carrying member 16 in a second angular position as described above.

To ensure secure frictional engagement of the inner wall 36 of the aperture 34 with the edge portions 32 and to protect inner wall 36 and outer surface 30 of the weight carrying member 16 from damage due to repeated use, either the inner wall 36 of the aperture 34 or the outer surface 30 of the weight carrying member 16 preferably is covered with a deformable, resilient material 38. This covering can be provided as an extruded sleeve which is slipped onto the weight carrying member, molded onto the weight carrying member or applied as a partially cured composition. Various suitable deformable materials can be used for this purpose, such as vinyl, urethane or polyester type plastics, other relatively soft plastics and rubber compositions. At present, vinyl plastics are preferred because of their lower costs and ease of extruding in a sleeve-like form.

In the preferred embodiment illustrated, the weight carrying member 16 includes a plurality of longitudinally spaced calibration marks 40 corresponding to different exercise loads and the outer surface 30 of the weight carrying member 16 is coated with the deformable, resilient material 38 which is substantially transparent so that calibration marks 40 are visible through the material 38.

Referring to FIGS. 1, 4, 5 and 6, the grip portion 14 includes a handle 40 extending transversely between the legs 22,24 and having opposed end portions 42,44 slidably mounted on the respective legs 22,24. Each of the end portions 42,44 includes a slot 46 for slidably receiving the respective leg 22,24. In the preferred embodiment illustrated, the handle 40 is a tubular member having a wall 48 and each end portion 42,44 includes diametrically opposed slots *46a,46b* in the wall 48 for slidably receiving the respective leg 22,24. The handle 40 preferably is covered with a resilient, grippable material 50, such as a foam material.

The handle 40 is movable along the legs 22,24 and relative to the cross member 26 to accommodate users having different sized hands and for performing different exercises as generally described in my U.S. application Ser. No. 08/047,251, filed Apr. 14, 1993, which is now U.S. Pat. No. 5,281,192, incorporated herein by reference. The handle 40 is releasably held in selected positions on the legs 22,24 by retainer members 52,54, each of which includes a mounting portion 56 fixedly mounted on the respective leg 22,24 by rivets 58 or the like and a deflectable portion 60 which releasably engages the handle 40 as described below. The retainer members 52,54 and the end portions 42,44 of the handle 40 are of identical construction, so only the retainer member 52 and the corresponding handle end portion 42 will be described in detail for the sake of brevity.

As shown most clearly in FIG. 5, the retainer member 52 includes a deflectable portion 60 which is movable between undeflected position $D_1$ illustrated by solid lines and a deflected position $D_2$ illustrated by dashed lines. The retainer member 52 is generally flat and made from a relatively flexible material, such as a relatively thin, elongated strip of metal, and the deflectable portion 60 is bent at an acute angle relative to the leg 22. The deflectable portion 60 has an exterior side 62 and an opposed, recessed interior side 64 including a plurality of axially spaced detent notches 68 corresponding to selected positions of the handle 40 relative to the cross member 26. Preferably, the retainer member 52 includes indicator marks 69 for indicating the relative hand size accommodated at each selected position of the handle 40.

The handle end portion 42 includes an opening 70 which is offset axially outwardly from the leg receiving slot 46 and is dimensioned to permit the handle end portion 42 to pass over the recessed interior side 64 of the deflectable portion 60 of the retainer member 52 (i.e., move back and forth relative to the cross member 26) when the deflectable portion 60 is in the deflected position $D_2$. One side of the opening 70 has a protrusion 74 for registering with a detent notch 68 and preventing subsequent movement of the handle 40 when the deflectable portion 60 is in the undeflected position $D_1$. When the deflectable portion 60 is deflected to deflected position $D_2$, a detent notch 68 is moved out of registration with the protrusion 74 and the handle 40 is free to be moved relative to the leg 22. After the handle 40 has been moved to a selected position, the deflectable portion 60 is released and, as it returns toward the undeflected position $D_1$, a detent notch 68 moves into registration with the protrusion 74. In the event the handle 40 is moved to a position where the protrusion 74 is not aligned with a detent notch 68 when the deflectable portion 60 is released, a biasing force applied by the deflectable portion 60 causes it to be moved into a detent notch 68 upon subsequent movement of the handle 40 relative to the leg 22. Although the operation of deflectable portion 60 has been described for positioning a single handle end portion 42, it should be understood that simultaneous deflection of the deflectable portions 60 of both retainer members 52,54 and movement of both handle end portions 42,44 is preferred.

The above-described arrangement for permitting the handle 40 to be moved to and retained at different positions relative to the cross member 26 has one or more advantage over prior art devices. For example, it permits the exercise device 10 to be used by persons having different sized hands and for different exercises without having to loosen and tightening set screws or remove, and relocate pins or bolts.

I claim:

1. An exercise device comprising an elongated weight carrying member having a longitudinal axis and an outer surface having a polygonal cross-sectional shape and including a plurality of edge portions extending parallel to said longitudinal axis;

at least one weight slidably mounted on said weight carrying member; and weight securing means for releasably securing said weight on said weight carrying member at selected locations along said longitudinal axis, said weight securing means including an aperture in said weight and through which the weight carrying member extends, said aperture including an inner wall and being dimensioned and having an arcuate cross-sectional shape different from the cross-sectional shape of the outer surface of said weight carrying member so that, when said weight is rotated relative to said longitudinal axis to a first angular position, said weight is frictionally disengaged from said weight carrying member and free to slide along said weight carrying member, when said weight is rotated relative to said longitudinal axis from said first angular position to a second angular position, the inner wall of said aperture frictionally engages at least two edge portions of said weight carrying member, thereby preventing subsequent longitudinal movement of said weight relative to said weight carrying member and, when said weight is rotated relative to said longitudinal axis from said second angular position back to said first angular position, said weight is again frictionally disengaged from said weight carrying member and free to slide along said weight carrying member.

2. An exercise device according to claim 1 wherein the inner wall of said aperture or the edge portions of said weight carrying member are covered with a deformable, resilient material.

3. An exercise device according to claim 1 wherein the aperture is generally egg-shaped and the weight carrying member has a rectangular cross-sectional shape.

4. An exercise device comprising a body;

an elongated weight carrying member connected to said body and having a longitudinal axis and an outer surface having a rectangular cross-sectional shape and including a plurality of edge portions extending parallel to said longitudinal axis;

a grip portion for gripping by user to perform an exercise movement connected to said body and extending transversely relative to said longitudinal axis;

at least one weight slidably mounted on said weight carrying member for movement between different locations along the longitudinal axis to vary the exercise load; and weight securing means for releasably securing said weight on said weight carrying member at selected locations along said longitudinal axis, said weight securing means including an aperture in said weight and through which the weight carrying member extends, said aperture including an inner wall and being dimensioned and generally egg shaped so that, when said weight is rotated relative to said longitudinal axis to a first angular position, said weight is frictionally disengaged from said weight carrying member and free to slide along said weight carrying member, when said weight is rotated relative to said longitudinal axis from said first angular position to a second angular position, the inner wall of said aperture frictionally engages at least two edge portions of said weight carrying member, thereby preventing subsequent longitudinal movement of said weight relative to said weight carrying member and, when said weight is rotated relative to said longitudinal axis from said second angular position back to said first position, said weight is again frictionally disengaged from said weight carrying member and free to slide along said weight carrying member.

5. An exercise device according to claim 4 wherein the inner wall of said aperture or the edge portions of said weight carrying member are covered with a deformable, resilient material.

6. An exercise device according to claim 4 wherein said weight carrying member includes calibration marks along said longitudinal axis.

7. An exercise device according to claim 4 wherein said body includes a pair of parallel spaced legs connected by and extending rearwardly from a cross member;

said grip portion includes a movable handle having opposed end portions and extending transversely between said legs;

a retainer member mounted on each of said legs for releasably holding the handle in selected positions on the legs;

said retainer member including an elongated, generally flat, flexible member having a mounting end fixedly mounted to said leg, a deflectable portion bent at an acute angle in relation to said leg and deflectable between undeflected and deflected positions, and a plurality of spaced apart detent notches in the deflectable portion; and each said handle end portion includes a slot receiving said respective leg for relative slidable movement, an opening offset axially outwardly from said slot for permitting the handle end portion to pass over the deflectable portion of said retainer member when the deflectable portion is in the deflected position, and a protrusion on one side of the opening for registering with a said detent notch and preventing subsequent movement of the handle when the deflectable portion is in the undeflected position.

8. An exercise device according to claim 7 wherein the handle is a tubular member having a sidewall and said slot is a pair of diametrically opposed slots in said sidewall.

9. An exercise device comprising:

a body including a pair of parallel spaced legs connected by a cross member;

a grip portion for gripping by a user to perform an exercise movement;

said grip portion including a movable handle having opposed handle end portions and extending transversely between said legs;

a retainer member mounted on each said leg for releasably holding the handle in selected positions on the legs;

said retainer member including an elongated, generally flat, flexible member having a mounting end fixedly mounted to said leg, a deflectable portion bent at an acute angle in relation to said leg and deflectable between undeflected and deflected positions, and a plurality of spaced apart detent notches in the deflectable portion; and each said handle end portion includes a slot receiving said respective leg for relative slidable movement, an opening offset axially outwardly from said slot for permitting the handle end portion to pass over the deflectable portion of said retainer member when the deflectable portion is in the deflected position, and a protrusion on one side of the opening for registering with a said detent notch and preventing subsequent movement of the handle when the deflectable portion is in the undeflected position.

10. The exercise device according to claim 9 wherein the handle is a generally tubular member having a sidewall and said slot is a pair of diametrically opposed slots in said sidewall.

11. A hand and arm exercise device comprising:

a generally U-shaped body including a pair of parallel spaced legs connected by and extending rearwardly from a cross member;

a grip portion for gripping by a user to perform an exercise movement, said grip portion including a movable handle having opposed end portions and extending transversely between said legs;

an elongated weight carrying member extending forwardly from said cross member and having a longitudinal axis and an outer surface including a plurality of edge portions extending parallel to said longitudinal axis;

at least one weight slidably mounted on said weight carrying member for movement between different locations along the longitudinal axis to vary the exercise load;

weight securing means for releasably securing said weight on said weight carrying member at selected locations along said longitudinal axis, said weight securing means including an aperture in said weight and through which the weight carrying member extends, said aperture including an inner wall and being dimensioned and shaped so that, when said weight is rotated relative to said longitudinal axis to a first angular position, said weight is free to slide along the longitudinal axis of said weight carrying member and, when said weight is rotated relative to said longitudinal axis to a second angular position, the inner wall of said aperture frictionally engages at least two edge portions of said weight carrying member, thereby preventing longitudinal movement of said weight relative to said weight carrying member;

a retainer member mounted on each said leg for releasably holding the handle in selected positions on the legs;

each retainer member is an elongated, generally flat, flexible member having a mounting end fixedly mounted to said leg, a deflectable portion bent at an acute angle in relation to the leg and deflectable between undeflected and deflected positions, and a plurality of spaced apart detent notches in the deflectable portion; and each said handle end portion includes a leg receiving slot, an opening offset axially outwardly from leg receiving slot to permit the handle end portion to pass over the deflectable portion of the retainer member when the deflectable portion is in the deflected position, and a protrusion on one side of the opening for registering with a detent notch and preventing subsequent movement of the handle when the deflectable portion is in the undeflected position.

12. The exercise device according to claim 11 wherein the handle is a generally tubular member having a sidewall and diametrically opposed slots in the end portions of the sidewall.

* * * * *